United States Patent [19]

Stangl

[11] Patent Number: 4,819,841

[45] Date of Patent: Apr. 11, 1989

[54] MANIPULATOR FOR ENGAGING A POURING TUBE WITH A DISCHARGE GATE VALVE OF A POURING LADLE

[76] Inventor: Kurt Stangl, A-4844 Regau 106, Austria

[21] Appl. No.: 104,804

[22] Filed: Oct. 2, 1987

[30] Foreign Application Priority Data

Oct. 22, 1986 [AT] Austria ..... 2801/86

[51] Int. Cl.[4] ..... B22D 37/00

[52] U.S. Cl. ..... 222/607; 164/437; 164/337

[58] Field of Search ..... 222/607, 606, 600, 591, 222/533, 526; 164/337, 438, 437; 901/15, 22

[56] References Cited

U.S. PATENT DOCUMENTS 3,460,725 8/1969 Golde et al. ..... 222/607 X
4,220,271 9/1980 Szadkowski ..... 222/607
4,550,867 11/1985 Bell et al. ..... 222/607
4,658,994 4/1987 Fricker ..... 222/607

FOREIGN PATENT DOCUMENTS 3425676 12/1985 Fed. Rep. of Germany .
1499333 10/1967 France ..... 164/337

*Primary Examiner*—Joseph J. Rolla
*Assistant Examiner*—Nils E. Pedersen
*Attorney, Agent, or Firm*—Kurt Kelman

[57] ABSTRACT

A manipulator for engaging a pouring tube (11) with the discharge gate valve of pouring ladle is designed so that the position of a cylinder (7) for turning a boom (4) for holding the pouring tube (11) depends on the pressure applied to the turning cylinder (7). This is accomplished by a spring (15) interposed between the turning cylinder (7) and the boom (4).

5 Claims, 2 Drawing Sheets

FIG. 2
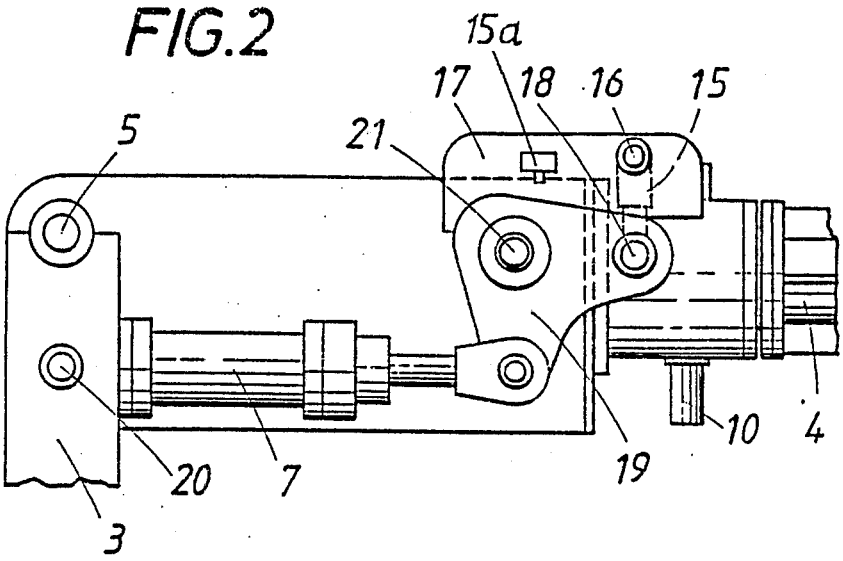
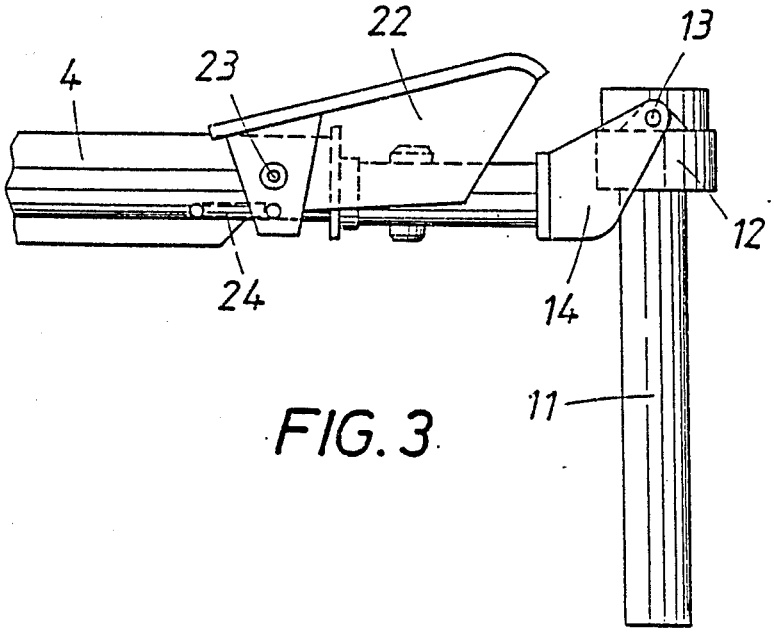
FIG. 3

MANIPULATOR FOR ENGAGING A POURING TUBE WITH A DISCHARGE GATE VALVE OF A POURING LADLE

BACKGROUND OF THE INVENTION

1. Field of the Invention

This invention relates to a manipulator for engaging a pouring tube with a discharge gate valve of a pouring ladle, which manipulator comprises a boom, which is pivoted on a horizontal axis and serves to hold the pouring tube, and a turning cylinder, which is interposed between the boom and an abutment.

2. Description of the Prior Art

To prevent an uncontrolled discharge of the molten steel from a pouring ladle into a succeeding tundish, a pouring tube forced against the bottom outlet of the pouring ladle serves to conduct the molten steel from the pouring ladle into the tundish. By means of a manipulator that pouring tube is engaged with suitable protruding centering means of the discharge gate valve of the pouring ladle and as the discharge gate valve is opened the pouring tube is moved to a position in front of the bottom outlet of the ladle. For that purpose the manipulator comprises a boom, which serves to hold the pouring tube and which is pivoted on a horizontal axis and adapted to be adjusted by means of a pivoting cylinder. That pivoting cylinder can be used to position the pouring tube, which is carried by the boom, and to force the pouring tube against the centering means of the discharge gate valve of the pouring ladle with a pressure force which is sufficient for the pouring operation. But those known manipulators have the disadvantage that the position of the boom or of the turning cylinder will not indicate to the operator of the manipulator whether the pouring tube is merely held against the discharge gate valve in a proper position or is forced against that valve by the force which is required for the pouring operation. For this reason the discharge gate valve may be improperly operated. If the discharge gate valve of the pouring ladle is operated before the pouring tube is forced against the discharge gate valve, molten steel can escape in an uncontrolled manner bewteen the discharge gate valve and the pouring tube. It must be taken into account in that connection that even when the pouring tube is subjected to the pressure force that is required for the pouring operation the boom must be shifted to move the pouring tube in unison with the discharge gate valve and the pouring ladle.

From Published German Application No. 3,425,676 it is known to replace the pivoting cylinder by an energy-storing spring device, which is stressed by hand via a toggle joint to force the pouring tube by means of the boom against the discharge gate valve of the pouring ladle. But because the toggle joint cannot be used to position the boom, the boom must be pivoted directly on the pouring ladle. As there is no defined intermediate position of the boom between its lower position of rest and its operating position, in which the pouring tube is forced against the discharge gate valve, the above-mentioned problem which arises in the operation of manipulators having a boom which is positionable by means of a pivoting cylinder does not arise.

SUMMARY OF THE INVENTION

It is an object of the invention to provide simple means by which a manipulator of the kind described first hereinbefore can be so improved that the position of the manipulator will indicate to the operator whether or not the pouring tube is subjected to the pressure force that is required for the pouring operation.

That object is accomplished in accordance with the invention in that a spring is provided between the pivoting cylinder, on the one hand, and the boom or the abutment, on the other hand.

Because the pivoting cylinder is either supported by a spring or acts on the boom through the intermediary of a spring, the pouring tube cannot be urged by a predetermined pressure force against the discharge gate valve of the pouring ladle unless the initial stress of the spring is overcome. If the initial stress of the spring is selected in consideration of the pressure force which is required in a given case, the operator will be able to detect, e.g., from the position of the pivoting cylinder, whether the pouring tube is held by the boom only in position against the discharge gate valve or is already being forced against said valve under the pressure required for the pouring operation. That indication is due to the fact that for the application of the required pressure the spring has been sufficiently deflected and this will be reflected by the position of the cylinder. When the cylinder has been extended to sufficiently deflect the spring, the pressure applied will be as high as or higher than a predetermined minimum value.

A particularly simple design will be obtained if, in accordance with a further feature of the invention, the pivoting cylinder is pivoted to a lever, which is supported on the boom by means of an interposed spring. In that case the lengths of the lever arms and a corresponding lever ratio can be selected to ensure a simple adaptation to the existing force relations and the application of pressure to the pivoting cylinder will be indicated by the angular position of the lever.

To preclude a maloperation of the discharge gate valve regardless of the attention of the operator, a switch for locking the discharge gate valve of the ladle may be provided and may be operable in response to the deflection of the spring. That locking switch will not enable an operation of the discharge gate valve until the pressure applied to the turning cylinder is sufficient to deflect the spring through the required extent.

If changing conditions are to be expected, it will desirable to permit an adjustment of the initial stress of the spring. If the spring has a predetermined stroke, a change of the initial stress of the spring will change the pressure which is to be applied to the pivoting cylinder in order to deflect the spring throughout its stroke.

The spring which is incorporated in the mechanism for turning the boom and which has an initial stress that is to be overcome before the pouring tube can properly be forced against the discharge gate valve of a pouring ladle can indicate that the pressure required for the pouring operation is being applied. But that indication does not ensure that the pouring tube has properly been engaged with the discharge gate valve. The required seal between the pouring tube and the discharge gate valve will not be ensured if the pouring tube is forced against the centering means of the discharge gate valve in an eccentric position. In order to ensure that such fault will also be detected, the boom may be provided with a springloaded feeler for detecting the depth of penetration of the pouring tube relative to the centering means of the discharge gate valve. That yieldable feeler may be used to inhibit the operation of the discharge gate valve so that a maloperation will be prevented regardless of the attention of the operator.

BRIEF DESCRIPTION OF THE DRAWING

FIG. 2 is a side elevation showing on a larger scale the clyinder for turning the boom, which cylinder is pivoted to a spring-loaded lever that is pivoted to the boom.

FIG. 3 is also a side elevation showing on a larger scale a spring-loaded feeler for detecting the depth of penetration of the pouring tube relative to the centering means.

DETAILED DESCRIPTION OF THE PREFERRED EMBODIMENT

Figure 1:
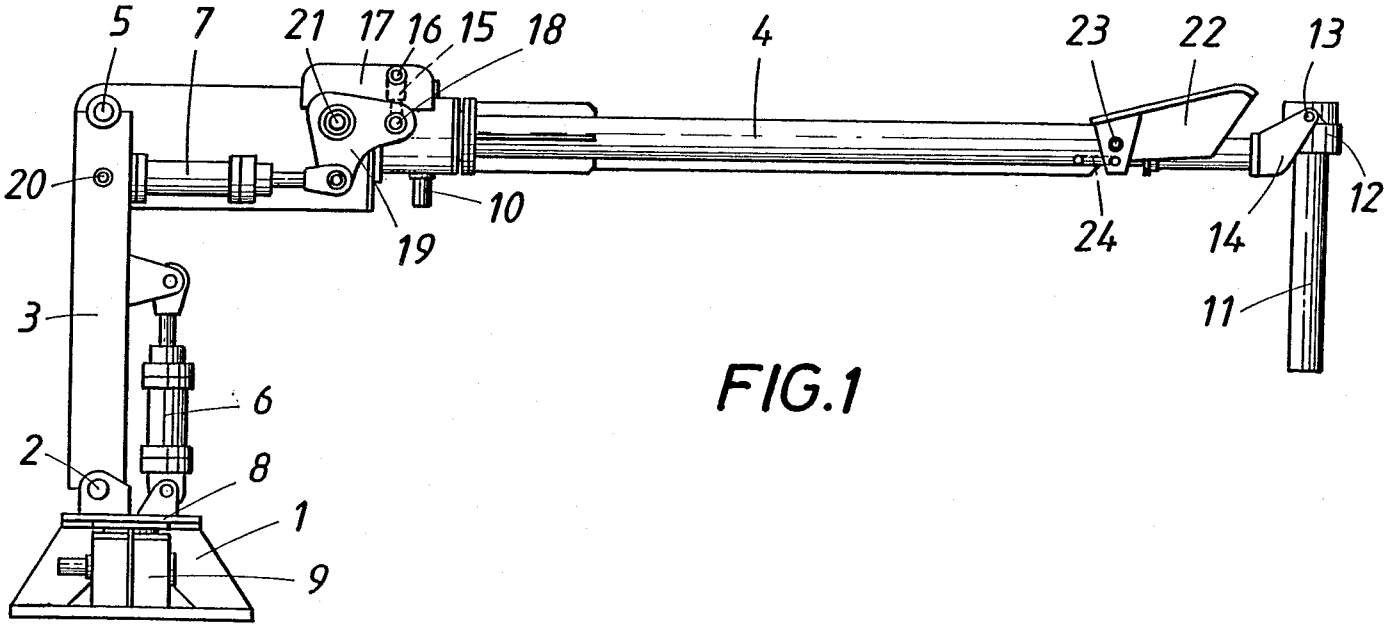
FIG. 1 is a simplified side elevation showing a manipulator in accordance with the invention for engaging a pouring tube with the discharge gate valve of a pouring ladle.

The illustrated manipulator comprises a post 3, which is pivoted on a horizontal pivot 2 to a base 1. A boom 4 is pivoted to said post 3 on a pivot 5, which is parallel to the pivot 2 for the post 3. A hydraulic cylinder 6 is provided for adjusting the post 3 relative to the base 1. By means of a pivoting clyinder 7, the boom 4 can be adjusted relative to the post 3. The post 3 and the boom 4 can be rotated in unison about a vertical axis. For this purpose the base 1 carries a rotatably mounted footplate 8, which is operable by a worm gear train 9. The boom 4 can also be rotated about its longitudinal axis by a swivel drive 10. The pouring tube 11 is held in an annular holder 12, which is pivoted on a pivot 13 to a forked free end portion of the boom 4. As a result, the pouring tube 11 can be moved not only along three coordinate axes but can also be rotated about the axis of the boom.

The supply of pressure fluid to the two cylinders 6 and 7 is controlled by a suitable control device. The two cylinders 6 and 7 are operated to position the pouring tube 11 and to engage it with the centering ring of the discharge gate valve of a pouring ladle and is then maintained in contact with the centering means under a pressure which is sufficient for the pouring operation. The application of that pressure which is required for the pouring operation should be indicated by the position of the manipulator. For this purpose the pivoting cylinder 7 engages the boom 4 through the intermediary of a spring 15. In the present embodiment, that spring 15 has been inserted into a telescopic tube, which is pivoted at one end by a pivot 16 to a supporting bearing 17 of the boom 4 and at the other end by a pivot 18 to a bell crank lever 19. The pivoting cylinder 7 bears on an abutment 20 provided on the post 3. Because the pivoting cylinder 7 acts on the lever 19, the spring 15 will be compressed by the pivoting cylinder 7 when the pouring tube 11 bears on the discharge gate valve. If the pressure force to be exerted by the pouring tube 11 on the discharge gate valve exceeds the force which ie due to the initial stress of the spring 15, the spring 15 will have to be correspondingly compressed for the exertion of the intended force on the pouring tube 11. The corresponding deflection of the spring 15 will be indicated by the angular position of the lever 19 about its pivot 21 or by the position of the pivoting cylinder 7 so that the position of the lever 19 and of the pivoting cylinder 7 will indicate to the operator whether or not the required pressure force is being exerted on the pouring tube 11. In addition, a switch **15*a* for locking the discharge gate valve may be provided and may be operable in dependence on the deflection of the spring 15. The locking switch will enable the operation of the discharge gate valve when the spring 15** has been sufficiently deflected so that the pouring operation can then be initiated.

The proper transfer of the molten steel from the pouring ladle through the pouring tube into the succeeding tundish will depend on the proper engagement of the pouring tube 11 with the centering means of the discharge gate valve of the pouring ladle. That proper engagement of the pouring tube can be tested by means of a feeler 22, which consists of a run-up rocker and is pivoted to the boom 4 on a pivot 23 adjacent to the annular holder 12 and is pivotally movable against the force of a spring 24. When the feeler 22 engages the pouring tube 11 as the latter is engaged with the discharge gate valve, the movement of the pouring tube 11 relative to the centering means of the discharge gate valve will impart to the feeler a pivotal movement toward the axis of the pouring tube through an angle which will depend on the depth of penetration of the pouring tube 11 relative to the centering means. A predetermined depth of penetration must be reached to ensure that the pouring tube 11 engaged with the centering means will properly be sealed when an adequate pressure is applied.

I claim:

1. A manipulator for engaging a pouring tube with a discharge gate valve of a pouring ladle, comprising:

(a) a supporting structure including an abutment, (b) a boom pivoted to said supporting structure for pivoting about a horizontal axis and adapted to hold said pouring tube, the boom being operable to engage said pouring tube with said discharge gate valve, and (c) a fluid-operable pivoting cylinder arranged between said abutment and said boom for pivotally moving said boom about said axis, one end of the cylinder bearing on the abutment and an opposite cylinder end being connected to said boom, wherein the improvement comprises (d) a spring supporting one of the cylinder ends, the spring having an initial stress of a smaller force than the pressure force required to engage the pouring tube with the discharge gate valve.

2. The manipulator of claim 1, wherein the spring is interposed between the opposite cylinder end and said boom.

3. The manipulator of claim 2, further comprising a lever pivoted to said boom, the opposite cylinder end being pivoted to said lever and said spring being connected between said lever and said boom.

4. The manipulator of claim 3, further comprising a switch actuatable by the pivoting lever for preventing an operation of said discharge gate valve unless said spring has been deflected to a predetermined extent.

5. The manipulator of claim 1 and adapted to move said pouring tube to a predetermined depth of penetration relative to centering means protruding from said discharge gate valve, further comprising a spring-loaded feeler carried by said boom for indicating when said pouring tube has been moved to said depth of penetration.

* * * * *